US006820466B2

(12) United States Patent
Streib

(10) Patent No.: US 6,820,466 B2
(45) Date of Patent: Nov. 23, 2004

(54) METHOD AND DEVICE FOR CONDUCTING A LEAKAGE TEST OF A TANK SYSTEM OF A VEHICLE

(75) Inventor: Martin Streib, Vaihingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/221,856

(22) PCT Filed: Mar. 9, 2001

(86) PCT No.: PCT/DE01/00883

§ 371 (c)(1),
(2), (4) Date: Oct. 28, 2002

(87) PCT Pub. No.: WO01/69073

PCT Pub. Date: Sep. 20, 2001

(65) Prior Publication Data

US 2003/0136182 A1 Jul. 24, 2003

(30) Foreign Application Priority Data

Mar. 17, 2000 (DE) ..... 100 13 347

(51) Int. Cl.[7] ..... G01M 3/04

(52) U.S. Cl. ..... 73/49.2; 73/49.2; 73/49.7; 73/40; 123/520

(58) Field of Search ..... 73/49.2, 49.7, 73/40; 123/520

(56) References Cited

U.S. PATENT DOCUMENTS

| | | | | | |
|---|---|---|---|---|---|
| 4,553,431 | A | * | 11/1985 | Nicolai | 73/290 B |
| 5,193,512 | A | * | 3/1993 | Steinbrenner et al. | 123/520 |
| 5,295,472 | A | | 3/1994 | Otsuka et al. | |
| 5,349,935 | A | * | 9/1994 | Mezger et al. | 123/520 |
| 5,857,447 | A | | 1/1999 | Shinohara | |
| 5,890,474 | A | * | 4/1999 | Schnaibel et al. | 123/520 |
| 6,123,060 | A | * | 9/2000 | Wild et al. | 123/520 |

FOREIGN PATENT DOCUMENTS

| | | |
|---|---|---|
| EP | 0 589 176 | 3/1994 |
| EP | 0 611 674 | 8/1994 |
| EP | 0 952 332 | 10/1999 |
| WO | WO/99/37905 | 7/1999 |

* cited by examiner

*Primary Examiner*—Hezron Williams
*Assistant Examiner*—André K. Jackson
(74) *Attorney, Agent, or Firm*—Walter Ottesen

(57) ABSTRACT

In a method for checking the tightness of a tank-venting system of a vehicle, one tightly closes the tank by means of a blocking device after shutting off the vehicle. Thereafter, one detects the pressure, which develops in the tank system, with a pressure sensor and draws a conclusion as to a leak based on the pressure trace over time. An arrangement for checking the tightness in accordance with this method is suggested.

7 Claims, 2 Drawing Sheets

METHOD AND DEVICE FOR CONDUCTING A LEAKAGE TEST OF A TANK SYSTEM OF A VEHICLE

FIELD OF THE INVENTION

The invention relates to a method and an arrangement for a tightness check of a tank system.

BACKGROUND OF THE INVENTION

Methods and arrangements for checking the tightness of tank systems have been known for some time in different embodiments. In most embodiments, an overpressure or underpressure is introduced into the blocked tank system and a conclusion is drawn as to tightness or untightness of the tank system based on the pressure gradient which builds up. Methods of this kind are presented, for example, in U.S. Pat. No. 5,890,474.

A method, known as "Natural Vacuum Leakage Detection (NVLD)" was presented at the SAE-Toptech-Conference, Indianapolis 1999. In this method, the tank is blocked by blocking means for a pregiven time span after the vehicle is shut off. In a tight tank, an underpressure then develops. In this method, an underpressure switch is provided which changes its switching state starting at a certain threshold value. This switching state is detected. If, within a pregiven time span, no switching operation is detected, then a conclusion is drawn as to the presence of a leak. The idea of this method is to utilize the underpressure, which settles normally over a period of time when switching off the vehicle and blocking the tank, in order to check the tightness of the tank system. Here, it is assumed that the underpressure arises because of a cooling down of the tank.

What is problematic here is that operating states exist wherein the expected cool-down of the tank does not occur in the shutoff phase; instead, even a warming takes place. An example of this is a trip in winter in cold surroundings and a subsequent switchoff of the vehicle in a warm garage.

Furthermore, a method of this kind does not consider different fuel types which have a vapor pressure, especially in ambient temperatures during summer, which lies above the ambient pressure, which is based on the fact that easily volatile components of the fuel boil in the tank. With this boiling operation, no underpressure can build up even with a cooling down of the tank; instead, an overpressure develops.

Whereas one possibly can eliminate the above-mentioned temperature dependency of the pressure present in the tank via the detection of the ambient temperature and so avoid a fault diagnosis, it is practically impossible without additional sensor means to detect in any way the boiling behavior of the fuel used and to consider the same in the diagnosis.

SUMMARY OF THE INVENTION

For this reason, the basis of the invention is to eliminate the above-mentioned disadvantages and to provide a method and an arrangement for checking the tightness of a tank system which makes possible a reliable detection of a leak in a manner simple to realize, on the one hand, independently of the ambient temperature and, on the other hand, independently of the fuel type present in the tank.

The advantage of the method of the invention for checking tightness of a tank system of a vehicle is that one can reliably draw a conclusion as to a leak from detecting the pressure trace in the blocked-off tank by means of a pressure sensor independently of whether an underpressure or overpressure develops in the tank. The advantage of detecting the pressure by means of a pressure sensor is especially that overpressures as well as underpressures can be detected by the pressure sensor so that a conclusion can be drawn as to a leak based on an adjusting or non-adjusting underpressure as well as based on an adjusting or non-adjusting overpressure.

In principle, one could detect the time-dependent gradient of the pressure trace with a pressure sensor and, based on this gradient, draw a conclusion as to a leak present in the tank.

An especially advantageous embodiment which does not require such a gradient measurement provides that one draws a conclusion as to a tight tank system when the pressure, which arises in the tank, passes either a pregivable underpressure threshold value or a pregivable overpressure threshold value after the elapse of a pregiven waiting time. In both cases, a conclusion can be drawn as to a tight system because an overpressure or underpressure will adjust when a leak is present.

It is especially advantageous that the method is not limited to the detection of an underpressure as is the case in the above-mentioned NVLD method. Rather, even with ambient influences for which an overpressure develops in the tank, a conclusion can reliably be drawn as to a leak with the method of the invention by utilizing the pressure sensor.

The processing of the pressure sensor signal in a control apparatus or a circuit unit permits a comparison to variable threshold values which are stored in the control apparatus.

Advantageously, it is provided that one draws a conclusion as to a non-tight system only when neither the underpressure threshold value nor the overpressure threshold value is passed within a pregiven time span with several pass-throughs of the above-described method.

The overpressure threshold value and the underpressure threshold value are advantageously fixed in dependence upon parameters, which characterize the ambient influences, such as the ambient temperature or the tank fill level. In this way, a considerable increase in accuracy of the tightness check is made possible.

In an arrangement according to the invention for checking tightness of a tank system of a vehicle, a drivable blocking means for tightly closing the tank system is provided as is a pressure sensor for detecting the pressure present in the tank system and a control unit for driving the blocking means as well as for processing the pressure sensor signals.

The advantage of this arrangement is its simple configuration. The arrangement can, for example, be subsequently provided very easily in existing tank systems because a control unit is present in all modern vehicles. Accordingly, only a pressure sensor need be provided in the tank system and a blocking means.

In vehicles having tank-venting systems, the function of the blocking means can advantageously be assumed by the tank-venting valve.

To achieve the above-mentioned increase in accuracy by detecting ambient influences, sensors for detecting the ambient influences can further be provided, especially sensors for detecting the ambient temperature and a sensor for detecting the tank fill level whose signals can be processed in the control apparatus.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
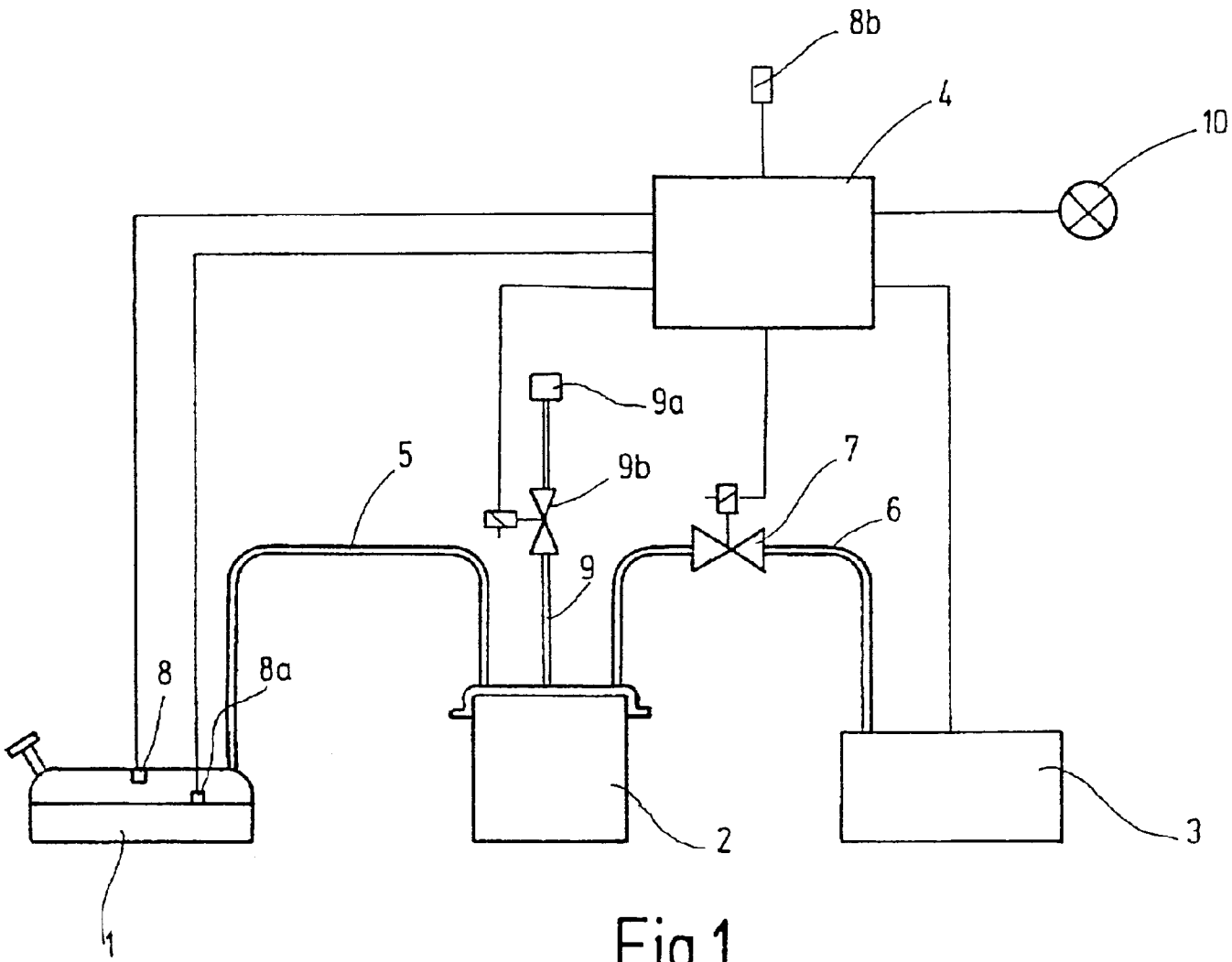
FIG. 1 shows a tank system of a vehicle wherein the method of the invention can be used; and, FIG. 2 is a schematic flowchart of the method of the invention.

An embodiment of a tank system of a vehicle is schematically shown in FIG. 1 and includes a tank 1 and an adsorption filter 2. The tank 1 is connected via a tank connecting line 5 to the adsorption filter 2. The adsorption filter 2 is connected with a further line 6 to an internal combustion engine 3. A blocking means in the form of a tank-venting valve 7 is mounted in the line 6. The tank-venting valve 7 is driven by the circuit unit 4. In the tank 1, a pressure sensor 8 is also mounted, whose output signals are likewise supplied to the circuit unit 4. The circuit unit 4 transmits and receives signals to and from the engine in a manner known per se. A fault lamp 10 functions to indicate diagnostic results.

Hydrocarbon substances arise in the tank because of vaporization and these substances deposit in the adsorption filter 2. The tank-venting valve 7 is opened to regenerate the adsorption filter 2 so that, because of the underpressure present in the intake manifold 6, air of the atmosphere is drawn by suction through a line 9, which is connected to the atmosphere, via a filter 9*a* through the adsorption filter 2, whereby the hydrocarbon substances (deposited in the adsorption filter 2) reach the intake manifold 6 and are supplied to the internal combustion engine 3. In this case, a valve 9*b* is switched into the open position. The valve 9*b* is mounted in the line 9 and is drivable by the circuit unit 4. Furthermore, a sensor 8*a* for detecting the tank fill level as well as a sensor 8*b* for detecting the ambient temperature can be provided and the signals thereof are supplied to the circuit unit 4.

Figure 2:
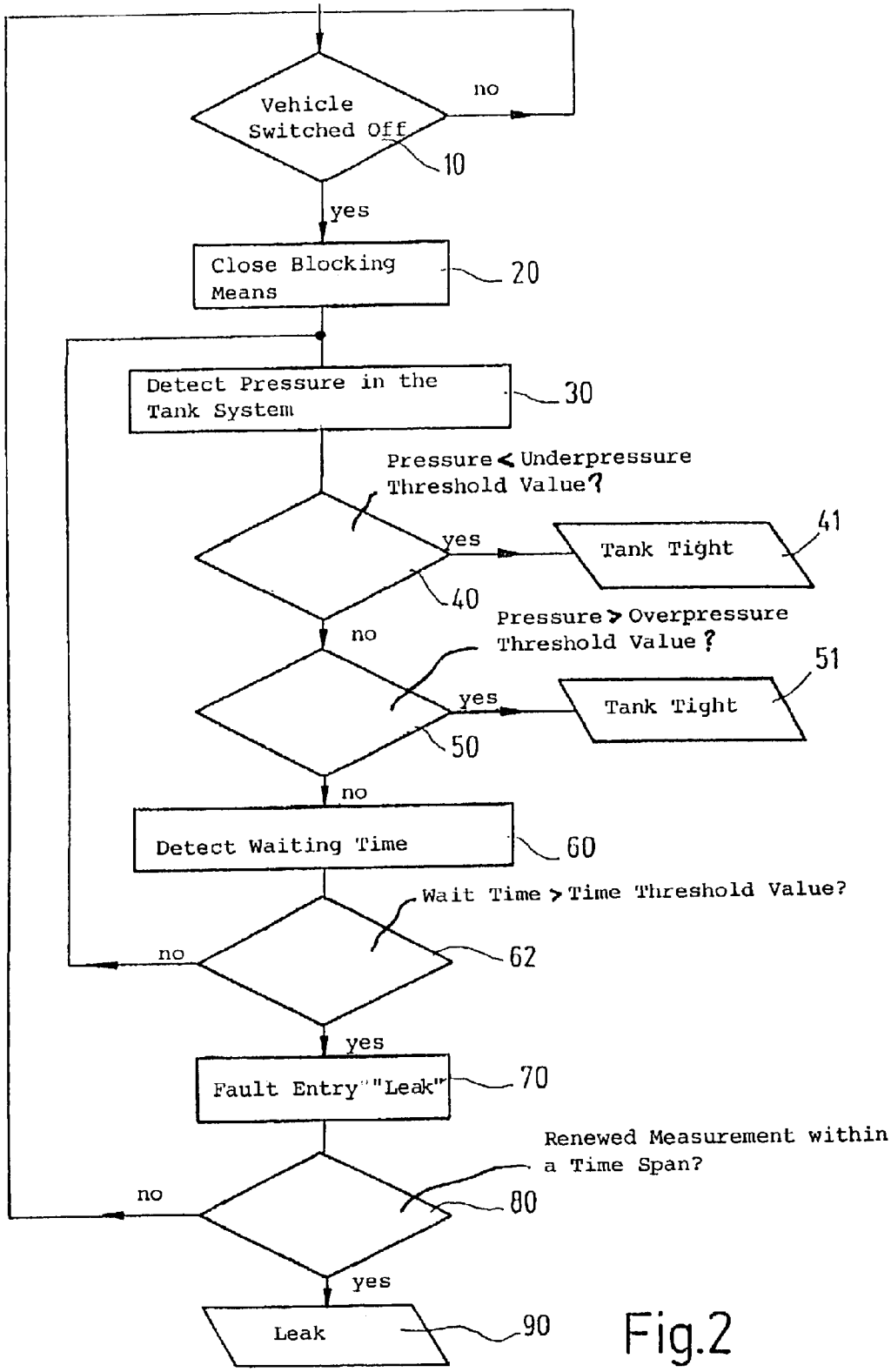

A method for checking tightness of such a tank system is explained hereinafter in connection with the flowchart shown in FIG. 2.

First, in step 10, a check is made as to whether the vehicle is switched off, that is, if the engine 3 is switched off and the vehicle is at standstill (step 10). If this is the case, then, in step 20, the tank-venting valve 7 is closed with which the tank can be tightly closed relative to the ambient. It is understood that, in this case, the line 9 is also tightly closed by the drivable valve 9*b*.

Then, in step 30, the pressure in the tank system is detected by means of the pressure sensor 8. The pressure is compared to a pregiven underpressure threshold value. If there is a drop below the underpressure threshold value, that is, if an underpressure builds up in the tank 1, which is greater than this underpressure threshold value, an announcement "tank tight" (step 41) is outputted and/or stored. If this is not the case, then a check is made in step 50 as to whether the pressure exceeds a pregiven overpressure threshold value, that is, whether an overpressure is building up in the tank 1. If this is the case, then, in turn, an announcement "tank tight" is outputted in step 51 and likewise stored.

If, in contrast, this is not the case, a check is made as to whether the waiting time has exceeded a pregiven time threshold value (steps 60 and 62). If this is not the case, the pressure continues to be detected and compared to the underpressure threshold value or overpressure threshold value in the above-described manner. In contrast, if the waiting time exceeds a pregiven time threshold value, a leak could be present and a fault entry "leak" is undertaken in a memory, for example, of the control unit 4 (step 70). A check is then made in step 80 as to whether at least a renewed measurement has taken place within a pregiven time span which preferably lies in the range of a week. If this is not the case, then a renewed measurement is undertaken at a later time point and, if this is the case and this measurement too has led to a fault entry "leak", a leak announcement is outputted in step 90 and finally stored in the memory and/or the fault lamp 10 is activated.

These method steps are, for example, carried out in the form of programs, circuits or the like via the electronic control unit 4, which drives not only the tank-venting valve 7 and the blocking valve 9*b* in dependence upon the operating state of the engine, but also evaluates the measuring results and, if required, activates a fault lamp 10.

The underpressure threshold value as well as the overpressure threshold value can be selected in dependence upon the trace of parameters such as the ambient temperature, which is detected by the temperature sensor 86, or the tank fill level which is detected by a tank-fill level transducer (not shown). In this way, an increase of the accuracy of the described tightness check is achieved.

What is claimed is:

1. A method for checking the tightness of a tank system of a vehicle, the method comprising the steps of:

switching off the engine of said vehicle and then blocking the tank of said tank system utilizing blocking means without first introducing an overpressure or underpressure into said tank system;

thereafter, detecting the passively developed pressure in the blocked-off tank system with a pressure sensor to obtain a trace of said pressure over time;

drawing a conclusion as to the presence of a leak from said trace;

drawing a conclusion as to a tight tank system when said pressure passes either a pregivable underpressure threshold value or a pregivable overpressure threshold value after the elapse of a pregiven waiting time; and, varying the underpressure threshold value and the overpressure threshold value in dependence upon parameters which characterize ambient influences.

2. The method of claim 1, comprising the further steps of:

trying to draw said conclusion as to a tight tank after several attempts to pass one of said threshold values over a pregiven time span; and, drawing a conclusion as to an airtight system when, after said pregiven time span, neither said underpressure threshold value is passed nor said overpressure threshold value is passed.

3. The method of claim 1, wherein said parameters include at least one of the ambient temperature and the tank fill level.

4. The method of claim 1, wherein said blocking means is a drivable tank-venting valve.

5. An arrangement for checking the tightness of a tank system, the arrangement comprising:

drivable blocking means for tightly closing said tank system without first introducing an overpressure or underpressure into said tank system;

a pressure sensor for detecting the passively developed pressure present in the closed tank system and emitting sensor signals indicative of said pressure;

a control unit for driving said blocking means and for processing said sensor signals;

ancillary sensors for detecting the ambient influences whose signals are processable in the control unit;

means for drawing a conclusion as to a tight tank system when said pressure passes either a pregivable underpressure threshold value or a pregivable overpressure threshold value after the elapse of a pregiven waiting time; and, means for varying the underpressure threshold value and the overpressure threshold value in dependence upon parameters which characterize ambient influences.

6. The arrangement of claim 5, said ancillary sensors including a sensor for detecting ambient temperature and a sensor for detecting the fill level of said tank.

7. The arrangement of claim 5, wherein the drivable blocking means is a tank-venting valve.

* * * * *